United States Patent [19]

Skubic et al.

[11] 4,074,812

[45] Feb. 21, 1978

[54] PALLET RACK

[75] Inventors: Leroy F. Skubic, LaPorte; Lucius B. Donkle, Jr., Michigan City; Donald L. Groth, LaPorte, all of Ind.

[73] Assignee: The Paltier Corporation, Michigan City, Ind.

[21] Appl. No.: 640,022

[22] Filed: Dec. 11, 1975

[51] Int. Cl.[2] ..... A47F 5/10

[52] U.S. Cl. ..... 211/192; 211/191; 211/208; 211/182

[58] Field of Search ..... 211/192, 187, 191, 208, 211/186; 248/220.5, 224, 235, 239, 243, 247, 248; 108/110, 111

[56] References Cited

U.S. PATENT DOCUMENTS

| | | | |
|---|---|---|---|
| 1,806,642 | 5/1931 | Ohnstrand | 248/243 X |
| 2,422,693 | 6/1947 | McArthur | 248/220.5 |
| 3,263,821 | 8/1966 | Klene et al. | 248/243 X |
| 3,266,635 | 8/1966 | McConnell | 211/187 X |
| 3,351,212 | 11/1967 | McConnell | 211/187 X |
| 3,414,224 | 12/1968 | Robilliard et al. | 211/192 X |
| 3,510,010 | 5/1970 | Gasner | 211/192 X |
| 3,601,432 | 8/1971 | Fenwick | 211/192 X |
| 3,697,034 | 10/1972 | Shell | 211/192 X |
| 3,702,137 | 11/1972 | Evans | 211/192 |
| 3,730,108 | 5/1973 | Stroh | 211/192 X |

*Primary Examiner*—Roy D. Frazier
*Assistant Examiner*—Robert W. Gibson, Jr.
*Attorney, Agent, or Firm*—Leydig, Voit, Osann, Mayer & Holt, Ltd.

[57] ABSTRACT

A metal pallet rack of the vertically adjustable type having at least four rectangularly spaced vertical support posts, a plurality of pairs of horizontal shelf beams detachably mounted on the posts by means of post-to-beam connectors, and a plurality of stamped steel metal hook elements integrally attached to each post-to-beam connector, the hook elements being detachably engageable with a vertical series of keyhole shaped apertures in the front wall of each post, each such keyhole shaped aperture having a minimum lateral dimension substantially greater than the gauge of the sheet metal of said hooks.

6 Claims, 11 Drawing Figures

PALLET RACK

DESCRIPTION OF THE INVENTION

The present invention relates to metal pallet racks of the vertically adjustable type finding particular but not exclusive utility in warehouses and supply depots. More particularly, the invention relates to an improvement over the prior pallet racks disclosed in U.S. Pat. Nos. 2,925,920 and 3,142,386 issued Feb. 23, 1960 and July 26, 1964, respectively, on the application of Leroy F. Skubic. One form of such prior rack is currently marketed by The Paltier Corporation, of Michigan City, Ind., under the designation "Series 3200 Standard Pallet Rack".

In prior pallet racks such as the "Series 3200", the front wall of each vertical post is provided with two sets of narrow wedge shaped slots for engagement by hooks integral with post-to-beam connectors. The connectors, including their hooks, are formed as heavy stampings of metal plate stock. The hook engaging portions of the post slots, being of generally wedge shaped form, taper in width to a minimum at their lower ends. They are thus adapted to receive and snugly engage the hooks of the post-to-beam connectors, and the parts are proportioned so as to leave a small clearance between the connector and the adjacent outer walls of the vertical post. Engagement between the hooks and slots is maintained by means of a releaseable locking device incorporated with each connector. The locking device is mounted above one of the connector hooks and engages the upper portion of the slot above the hook until manually released. This arrangement permits limited horizontal pivotal movement between the post and the connectors engaged therewith, without disengagement or collapse, in the event of an accidental impact which displaces the post horizontally.

The present invention represents an improvement over still another prior pallet rack which is also currently marketed. This prior rack bears some similarity to the prior racks just mentioned but utilizes different vertical posts and post-to-beam connectors. The posts are formed with relatively wide keyhole shaped apertures which slidingly interfit with headed studs on the post-to-beam connectors. The connectors themselves abut against the outer walls of the vertical post and may utilize a separate locking means to preclude disengagement. These post-to-beam connections do not permit the substantial horizontal pivotal movement of the prior racks discussed above in event of horizontal displacement of the post due to accidental impact. Although this type of rack is supplied with overall dimensions relatively close to those of the other prior racks mentioned above, their components are not interchangeable.

It is, accordingly, an object of the present invention to provide a vertically adjustable pallet rack with post-to-beam connectors having stamped sheet metal hooks, the components of which rack will be interchangeable with those of prior racks having relatively wide keyhole shaped apertures which slidingly interfit with headed studs on the post-to-beam connectors.

Another object of the invention is to provide a pallet rack of the foregoing interchangeable type wherein the post-to-beam connectors will be adapted to tolerate substantial inward displacement of a post unit, due to an accidental impact, without disengagement or collapse.

A further object is to provide a pallet rack of the character set forth above having post-to-beam connectors which will readily engage and disengage within a wide range of tolerances and without appreciable deformation of the post apertures.

Still another object is to provide a pallet rack of the foregoing type having an improved releasable locking device incorporated in the post-to-beam connectors.

Other objects and advantages of the present invention will become apparent as the following description proceeds, taken in connection with the accompanying drawings, wherein.

Figure 8:
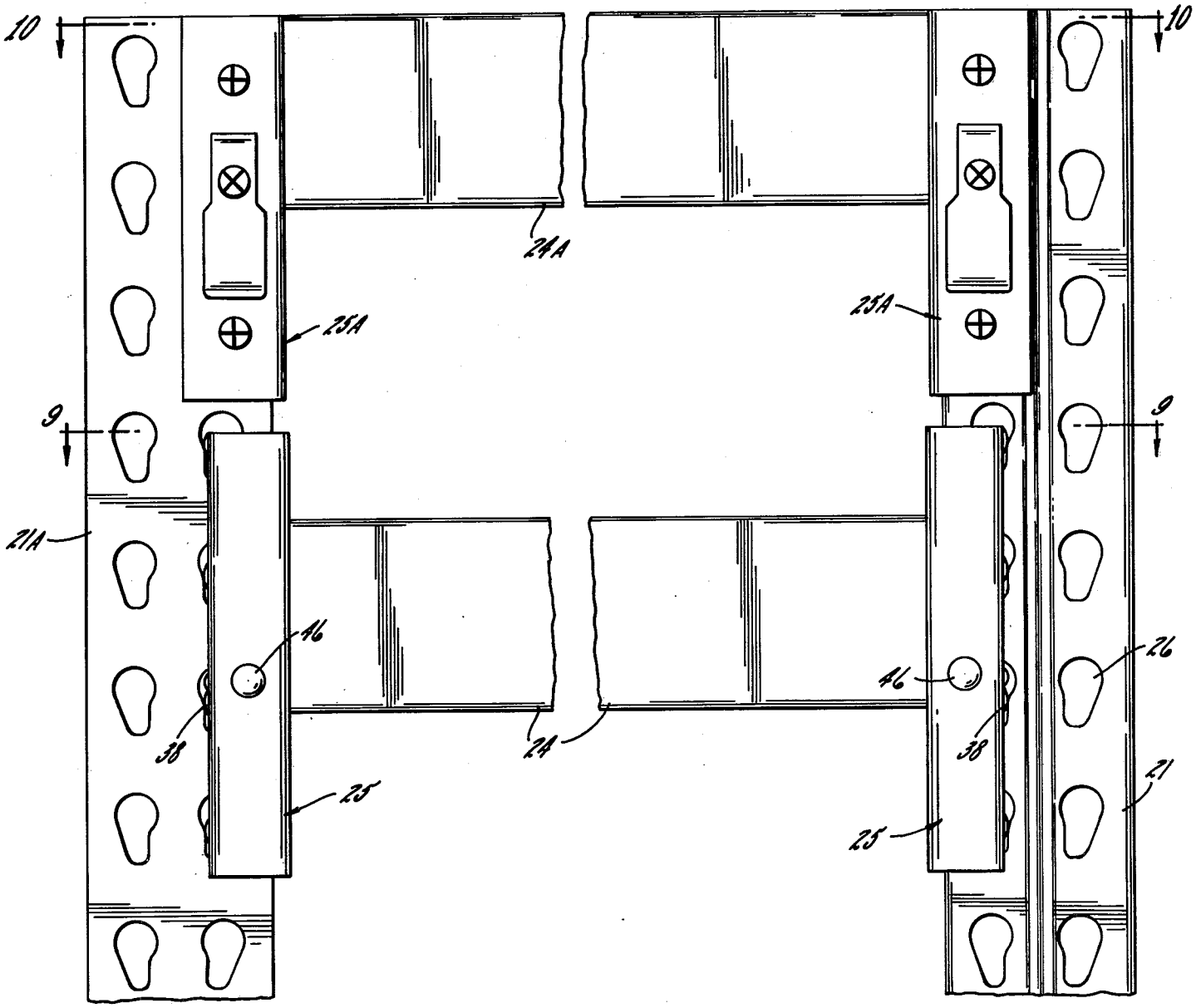
FIG. 8 is a front elevational view of a pallet rack illustrating the interchangeability of the post and beam components in the rack of FIG. 1 with those of another well known type of pallet rack currently in commercial use.
Figure 9:
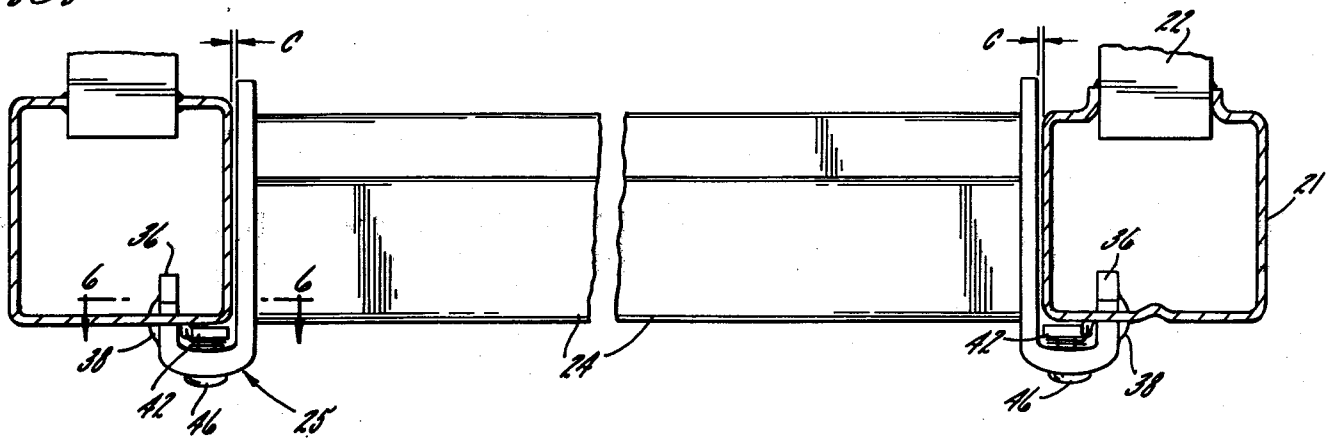
Figure 10:
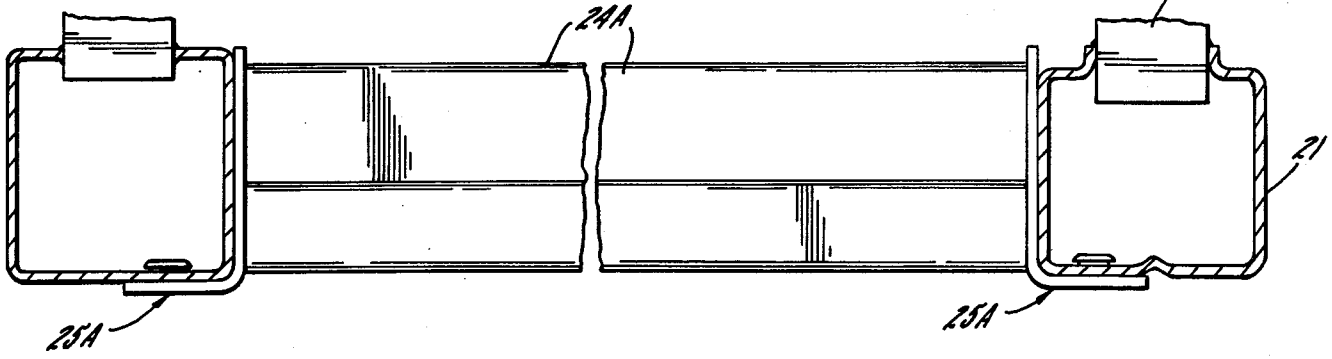

FIGS. 9 and 10 are horizontal sectional views taken through the rack structure of FIG. 8 in the planes of lines 9—9 and 10—10, respectively.

While the invention is susceptible of various modifications and alternative constructions, certain illustrative embodiments have been shown in the drawings and will be described below in considerable detail. It should be understood, however, that there is no intention to limit the invention to the specific form disclosed but, on the contrary, the intention is to cover all modifications, alternative constructions, and equivalents falling within the scope of the appended claims.

Figure 1:
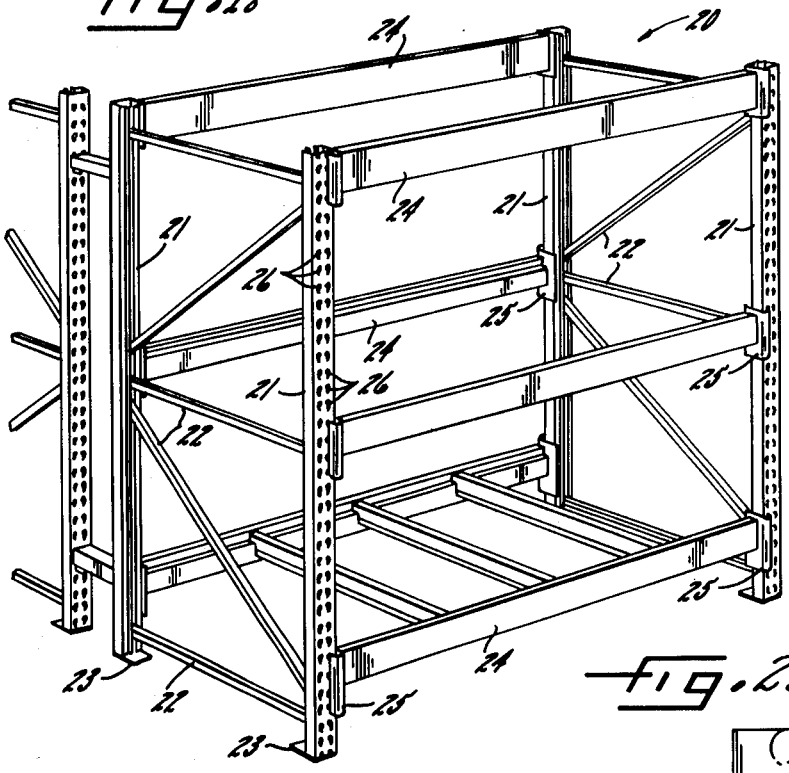
FIG. 1 is a perspective view of a vertically adjustable pallet rack embodying the present invention.

Referring more specifically to FIG. 1, the invention is there examplified in an illustrative pallet rack 20 which may represent one unit of many similar units in a warehouse installation. The rack 20 in this case comprises two opposed pairs of vertical posts 21, each pair being secured together by suitable cross members 22 to define a vertical frame and having base plates 23 for anchoring it to the floor. The opposed pairs of posts 21 support a plurality of vertically spaced pairs of shelf beams 24 each having a multiple hooked post-to-beam connector 25 at either end. The beams 24 are detachably connectable and vertically adjustable on the posts 21.

Figure 5A:
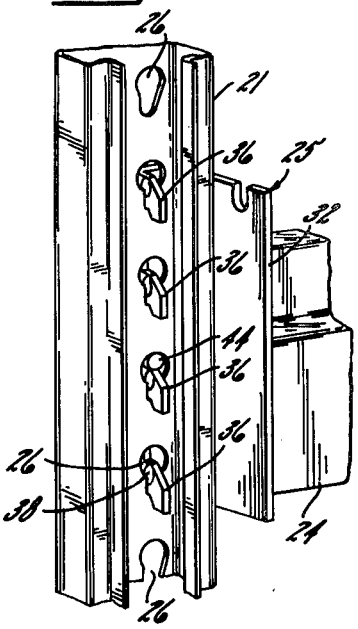
FIG. 5A is a fragmentary perspective view, to a somewhat smaller scale than FIG. 5, showing the rear side of a post with the post-to-beam connector of FIG. 5 mounted in position thereon.
Figure 2:
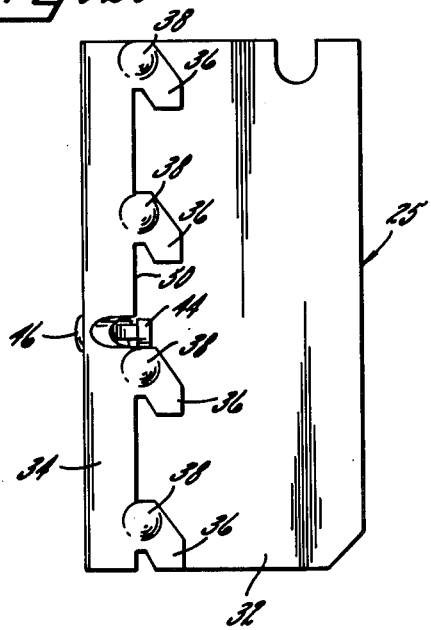
FIG. 2 is an end elevational view of a post-to-beam connector utilized in the rack of FIG. 1.
Figure 3:
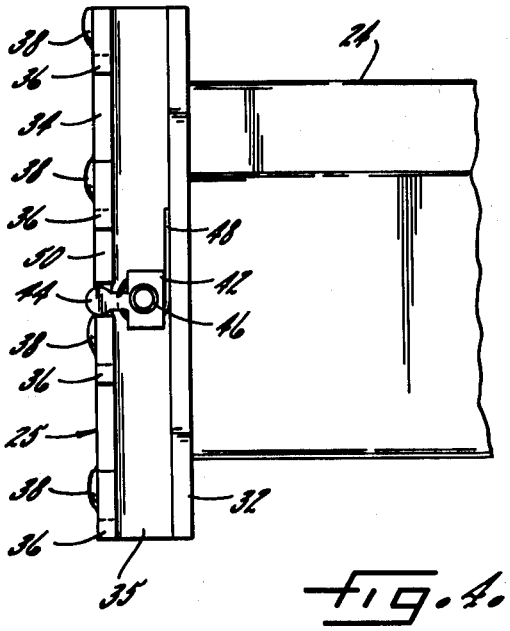
FIG. 3 is a rear elevational view of the post-to-beam connector shown in FIG. 2.
Figure 4:
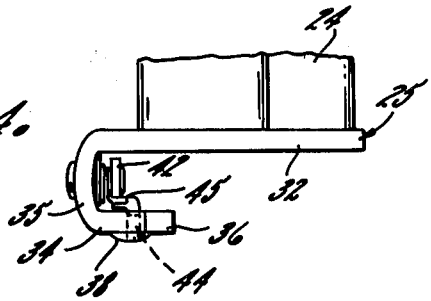
FIG. 4 is a plan view of the post-to-beam connector shown in FIG. 2.
Figure 5:
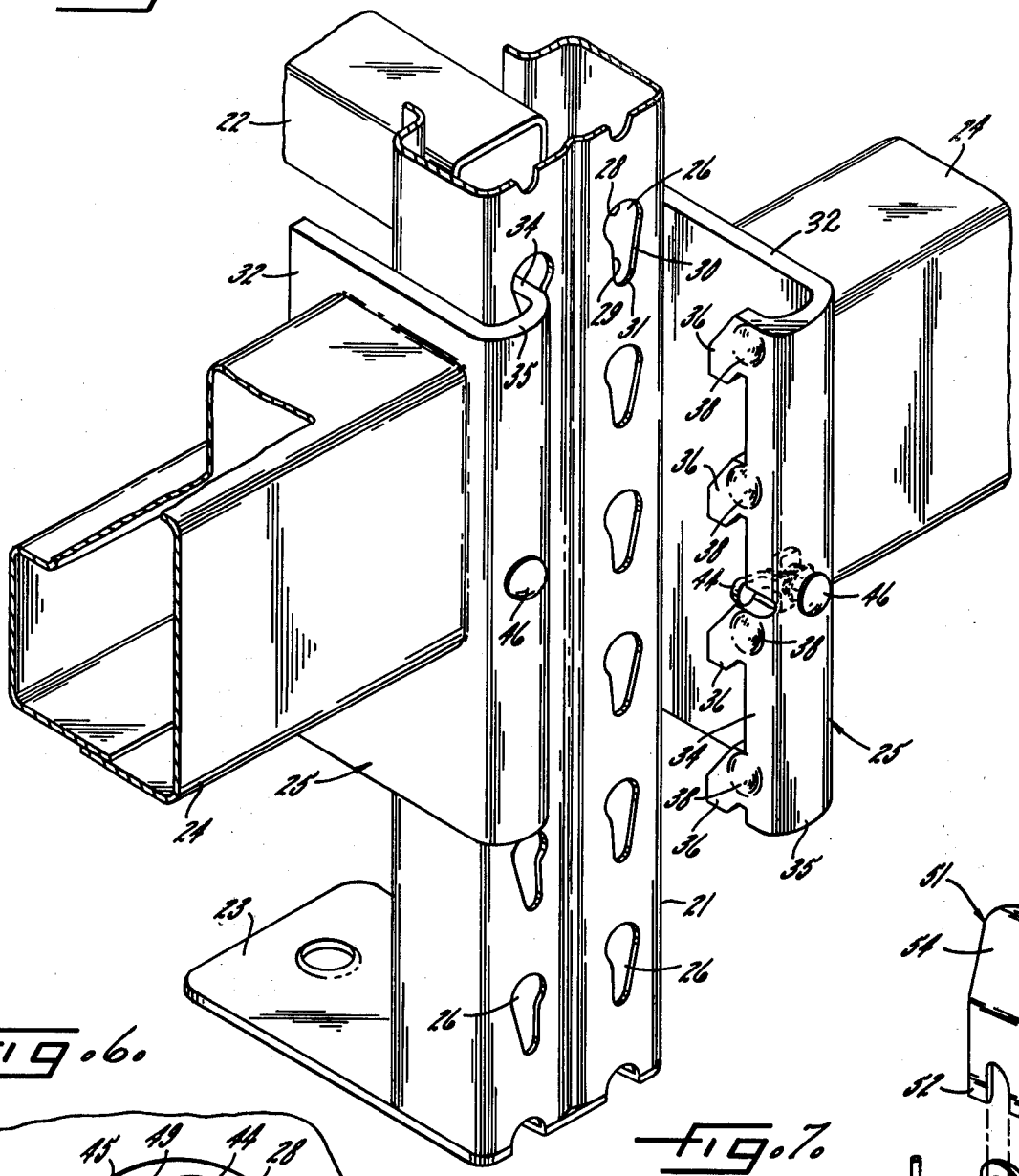
FIG. 5 is an enlarged fragmentary perspective view showing two post-to-beam connectors utilized in the rack of FIG. 1, one engaged to the post and the other disengaged from the post.
Figure 6:
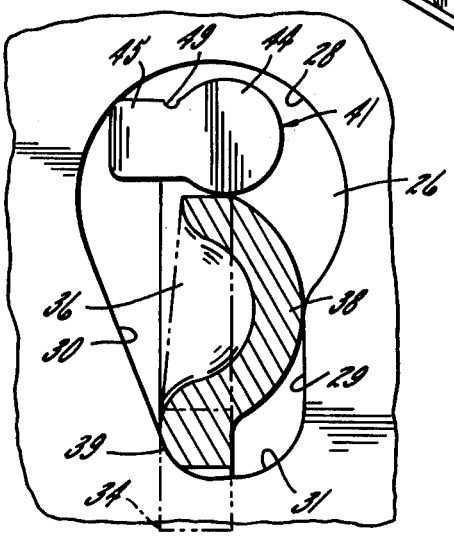
FIG. 6 is an enlarged vertical sectional view through one of the hooks of the beam to post connector of FIG. 2, taken in the plane of the line 6—6 in FIG. 9 with the hook engaged in a post aperture.

Each of the posts 21 is formed with an outwardly facing wall having two vertically extending sets of uniformly spaced keyhole shaped apertures 26 (FIGS. 1, 5 and 5A) for engagement by the post-to-beam connectors 25 of the shelf beams 24. Referring more specifically to FIGS. 5, 5A and 6, it will be noted that each keyhole shaped aperture 26 has an upper portion 28 of generally circular shape merging on one side into a vertical side wall 29 and on the other side into a downwardly inclined side wall 30 which converges toward the vertical wall 29. Both walls 29, 30 merge with an arcuate bottom wall 31. The keyhole shaped apertures 26 are relatively wide and comparable in size to those of the prior rack which utilizes post-to-beam connectors of the headed stud type discussed earlier herein.

Each of the post-to-beam connector brackets 25 (FIGS. 2-5A) is fabricated as a relatively heavy stamping metal plate stock. The connector 25 includes a first wall 32 fixed to the end of the shelf beam and having an area somewhat greater than the cross section of the beam so as to leave an overlapping margin on all sides. At its front vertical edge, the first wall 32 is bent generally longitudinally and then perpendicular to the axis of the beam, defining a relatively short second wall 34 spaced apart from and approximately parallel to the first wall 32. The second wall 34 is thus connected to the first wall 32 by a relatively short bridging wall 35 which extends the full vertical height of the walls 32, 34. The second wall 34 is formed with hook means for engaging the keyhole shaped apertures 26 in the vertical posts.

Provision is made in the structure of the stamped metal plate connector 25 for snugly engaging a plurality of the adjacent keyhole apertures 26 of the post 21 while permitting a limited amount of horizontal pivotal movement therebetween in the event that the post 21 should be accidentally displaced horizontally due, for example, to the impact of a fork-lift truck. Pursuant to this objective, the second wall 34 of the connector bracket 25 is formed with a plurality of downwardly extending hooks 36, in this case four in number, adapted to engage a corresponding number of the keyhole apertures 26. The wall 34 and its hooks 36 are spaced from the connector wall 32 by an amount which will result in a clearance *c* on the order of 1/16 inch between the wall 32 and the side wall of the post 21 when the connector is engaged with the post (FIG. 9).

It will be noted that each keyhole aperture 26 is relatively wide and that its minimum lateral dimension is substantially greater than the gauge of the metal plate forming the hooks 36, being on the order of approximately twice the gauge of the plate stock of the hooks, as shown in FIG. 6. Accordingly, to insure snug engagement of the aperture 26 and avoid precluding limited horizontal pivotal movement of the connector 25 relative to the post, each of the hooks 36 is formed with a bulbous embossment or projection 38 above its throat. The projection 38 is situated on the side of the hook remote from the connector wall 32 and is adapted to abut against the vertical side wall 29 of the keyhole aperture (FIGS. 5A, 6). On the side of the hook opposite the bulbous projection 38, the throat of the hook is fashioned with a small transverse radius 39 adapted to abut against the arcuate bottom wall 31 of the keyhole aperture adjacent the junction with the inclined wall 30. When the parts are assembled, the straight portion of the throat of the hook may approach contact with the arcuate bottom wall 31 or may remain slightly above it as indicated in FIG. 6. At the same time that the hook 36, its projection 38 and radius 39 are engaging the keyhole slot as just described, corresponding engagement is occuring between the neighboring hooks 36 of the connector 25 and the respective keyhole apertures 26 associated with them (FIG. 5A).

In order to secure the hooks 36 and keyhole apertures 26 in engaged condition, each post-to-beam connector 25 is provided with a releasable locking device 40 (FIGS. 2–7). The device 40 comprises a bolt 41 which may be fashioned as a metal plate stamping having a body 42, a generally circular head 44 offset from the plane of the body, and a neck 45 connecting the head and body. The body 42 is fixed to a headed plunger 46 which is slidably mounted in a hole through the central portion of the bridge wall 35 and surrounded by an axial and torsional biasing spring 48. The parts are so arranged that the bolt head 44 is disposed immediately above the underlying hook 36 and transversely of the plane of the hook. The biasing spring 48, acting between the face of the first wall 32 of the connector and notch 49 on the upper surface of the bolt neck 45, urges the bolt head 44 against the top of the hook 36. The spring 48, also acting between the bridging wall 35 and the bolt body 42, simultaneously forces the plunger inwardly so that the head of the plunger 46 engages the outer surface of the bridging wall 35 with the bolt head 44 projecting beyond the post engaging surface 50 of the second wall 34. This places the bolt head 44 in position to enter the keyhole aperture 26 when the hook 36 engages the keyhole aperture. The dimensions of the bolt head 44 are such that under this condition, the bolt head will have a slight clearance distance with the upper portion 28 of the keyhole aperture 26, as shown in FIG. 6, but will act as a positive lock against withdrawal of the hook 36 from the aperture. By the same token, such locking action precludes withdrawal of the other hooks 36 of the connector bracket 25 from their associated apertures.

Figure 7:
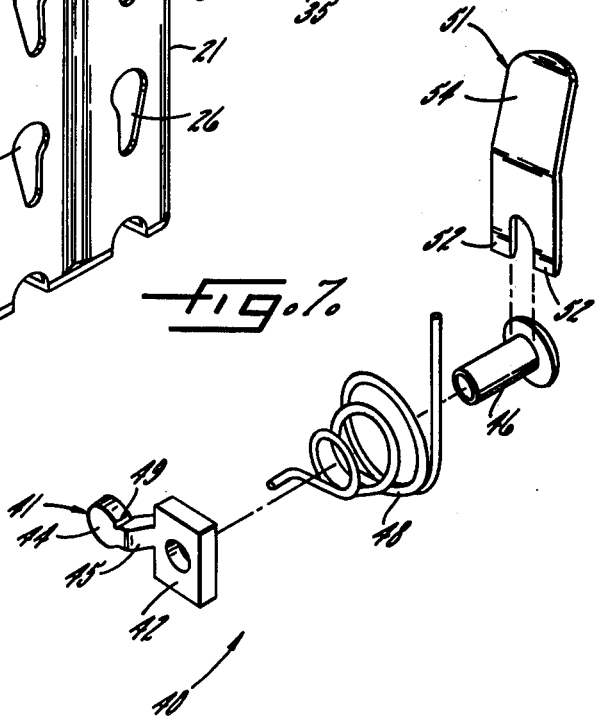
FIG. 7 is an enlarged, exploded perspective view of the locking device incorporated in the post-to-beam connector of FIG. 2.

The locking device 40 may be released by the use of a bolt extractor 51 (FIG. 7). The latter is a separate element comprising a bifurcated end portion with a pair of tapered blades 52 and a tab portion 54 disposed at a small angle to the plane of the blades 52. The tab 54 is gripped so that the blades 52 are forced under the head of the plunger 46. By then pressing the tab toward the convex face of the connector bridging wall 35, the plunger 46 is pulled outwardly and the bolt head 44 is thus withdrawn clear of the keyhole aperture 26. The hooks 36 of the connector 25 may then be readily lifted up and withdrawn from their associated keyhole apertures 26.

Turning next to FIGS. 8–10, the interchangeability of the pallet rack embodying the present invention with the type of prior pallet rack utilizing post-to-beam connectors of the headed stud type is there demonstrated. Referring particularly to FIG. 8, a pair of vertical posts is shown, the right hand one being a post 21 exemplifying the present invention and the left hand one a post 21A of the prior pallet rack. Spanning the posts 21, 21A are two horizontal beams and their beam to post connectors. The lower horizontal beam 24 utilizes connectors 25 embodying the invention described earlier herein. The upper horizontal beam 24A utilizes post-to-beam connectors 25A of the headed stud type and is a prior rack beam. Both components fit interchangeably. However, the beam 24 and its connectors 25, when used with either the post 21 or post 21A, permit substantially more horizontal pivotal movement between a connector and its associated post when the post is accidentally displaced horizontally due to an accidental impact.

This is a significant safety feature, enabling the rack to give horizontally under impact without structural damage or liklihood of collapse.

We claim as our invention:

1. In a vertically adjustable pallet rack having at least four rectangularly spaced vertical support posts and pairs of spaced horizontal shelf beams mounted between corresponding pairs of said posts, each said post having a front wall and rearwardly extending side walls facing each other, the combination comprising:

a. a post-to-beam connector fixed to the end of each horizontal shelf beam, said connector having a first wall attached to the shelf beam;

b. a second wall laterally spaced from said first wall;

a bridge wall connecting said first and second walls;

d. means defining two vertically disposed series of keyhole shaped apertures in the front wall of each post, said series being spaced from each other and from the side walls of the post, e. each said aperture having a relatively wide upper portion of generally circular shape and a narrower lower portion defined by a vertical side adjacent the central portion of said post and an inclined side tapering downwardly to an arcuate bottom wall portion connecting said vertical and inclined sides;

f. at least two vertically spaced hooks defined in said second wall of said connector for engagement with the apertures of the post, said hooks lying in a common plane;

g. each said hook having a throat and a bulbous projection above said throat adapted to engage the vertical wall of the aperture while said throat engages the arcuate bottom wall portion of the aperture at a point spaced vertically below said bulbous projection on the opposite side of said hook therefrom above the bottom of the aperture in a direction generally normal to said arcuate bottom wall portion; and h. said first wall of said connector defining a clearance space with respect to the side of said post when said connector is attached to said post.

2. The combination as defined in claim 1 including a releasable locking bolt disposed transversely of the plane of said hook, said bolt being spring biased downwardly against the top of said hook and in position to enter said aperture as an incident to entry of said hook, said bolt being substantially coplanar with said aperture following entry of said hook.

3. The combination as defined in claim 1, including:

a. a plurality of hooks of stamped metal plate stock integrally attached to each post-to-beam connector; and b. each said keyhole shaped aperture having a minimum lateral dimension on the order of approximately twice the gauge of the metal plate stock of said hooks, and a maximum lateral dimension substantially greater than said minimum lateral dimension.

4. The combination defined in claim 1 wherein each of said hooks has a throat with a relatively small transverse radius engaging the arcuate bottom wall portion of the aperture on the side opposite said convex embossment.

5. The combination defined in claim 2 wherein said releasable locking bolt has a two-way biasing spring urging said bolt downwardly against the top of said hook and outwardly toward the plane of said keyhole aperture.

6. In a vertically adjustable pallet rack having four rectangularly spaced vertical support posts and pairs of spaced horizontal shelf beams mounted between corresponding pairs of said posts, each said post having a front wall and rearwardly extending side walls facing each other, the front wall of each post having a series of vertically disposed regularly spaced apertures therein spaced from the side wall thereof, each aperture being generally keyhole shaped and defined by a straight side and a tapered side the latter tapering downwardly to an arcuate portion at the bottom of the aperture, the improvement comprising, in combination:

a. a post-to-beam connector fixed to the end of each horizontal shelf beam, said connector having a first wall attached to the shelf beam;

b. a second wall laterally spaced from said first wall;

c. a bridge wall connecting said first and second walls;

d. a plurality of vertically spaced hooks defined in said second wall for engagement with the apertures of the post;

e. each said hook having a bulbous projection above the throat of said hook adapted to engage the straight wall of the aperture while the throat of said hook engages the arcuate bottom wall portion of the aperture;

f. a releasable locking bolt disposed transversely of the plane of one said hook and in position to enter the keyhole shaped aperture associated therewith;

a headed plunger fixed to said releasable locking bolt and projecting through an opening in said bridge wall; and h. a combined torsional and axial biasing spring surrounding said plunger, said spring urging said locking bolt downwardly against the top of said hook and outwardly toward the plane of said keyhole shaped aperture.

* * * * *